US005687418A

United States Patent [19]

Earle et al.

[11] Patent Number: 5,687,418

[45] Date of Patent: Nov. 11, 1997

[54] PROCESSING APPARATUS

[75] Inventors: Anthony Earle, Harrow Weald; Michael Ridgway, Herts, both of England

[73] Assignee: Eastman Kodak Company, Rochester, N.Y.

[21] Appl. No.: 549,611

[22] Filed: Oct. 27, 1995

[30] Foreign Application Priority Data

Oct. 29, 1994 [GB] United Kingdom ..... 9421812

[51] Int. Cl.[6] ..... G05D 3/08

[52] U.S. Cl. ..... 396/602; 396/612

[58] Field of Search ..... 354/308, 310–312, 354/315, 319–322, 324, 339, 340; 396/602, 612

[56] References Cited

U.S. PATENT DOCUMENTS

| | | | |
|---|---|---|---|
| 1,164,773 | 12/1915 | Woodman | 396/612 |
| 3,087,406 | 4/1963 | Dutch | 396/603 |
| 3,287,013 | 11/1966 | Fairbanks et al. | 226/181 |
| 3,593,988 | 7/1971 | Collins | 271/39 |
| 3,712,206 | 1/1973 | Schmidt | 354/322 |
| 4,185,709 | 1/1980 | Irvine | 271/229 |
| 4,469,425 | 9/1984 | Cocco et al. | 354/310 |
| 4,506,880 | 3/1985 | Dixon et al. | 271/263 |
| 4,583,873 | 4/1986 | Parks et al. | 271/170 |
| 4,616,915 | 10/1986 | Norris | 354/320 |
| 4,990,011 | 2/1991 | Underwood et al. | 400/636 |
| 5,120,040 | 6/1992 | Worley | 271/119 |
| 5,136,144 | 8/1992 | Swinton et al. | 271/227 |
| 5,184,533 | 2/1993 | Golicz | 83/24 |
| 5,222,724 | 6/1993 | Hirano et al. | 271/10 |
| 5,255,903 | 10/1993 | Parsons et al. | 271/10 |
| 5,316,283 | 5/1994 | Tyson et al. | 271/114 |
| 5,435,539 | 7/1995 | Namiki | 271/114 |
| 5,528,329 | 6/1996 | Sawada et al. | 392/612 |

FOREIGN PATENT DOCUMENTS

| | | |
|---|---|---|
| 0 401 807 | 12/1990 | European Pat. Off. . |
| 0 620 493 | 10/1994 | European Pat. Off. . |
| 1099212 | 1/1968 | United Kingdom . |

*Primary Examiner*—D. Rutledge
*Attorney, Agent, or Firm*—Frank Pincelli

[57] ABSTRACT

It is known to process photographic materials in sheet form in deep, narrow processing tanks. In these tanks, the material needs to be supported so that it can be removed from the tank once processing is complete. This may result in insufficient agitation of the processing solution over the surface of the material due to the presence of the support or restraint. Described herein is improved processing apparatus in which pairs of D-shaped rollers are located within respective ones of the processing tanks. When material is being processed, flat portions of each pair of D-shaped rollers are parallel to one another allowing clear access to the processing tanks. When processing is complete in a particular processing tank, rotation of each D-shaped roller of the pair associated with that tank about its respective axis brings the circular circumferential surfaces of each pair of rollers into contact to grip the material and direct it out of the processing tank.

11 Claims, 4 Drawing Sheets

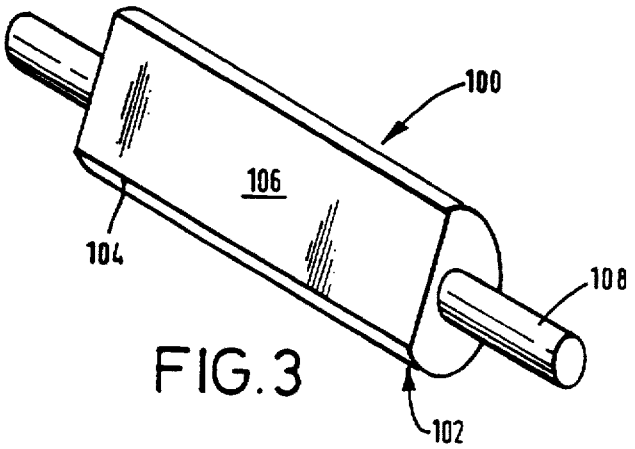
FIG.3
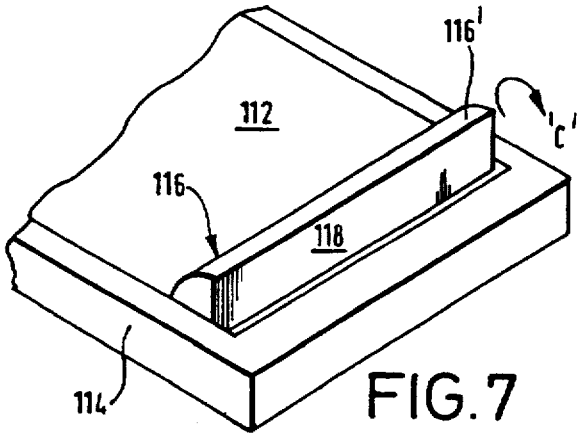
FIG.7
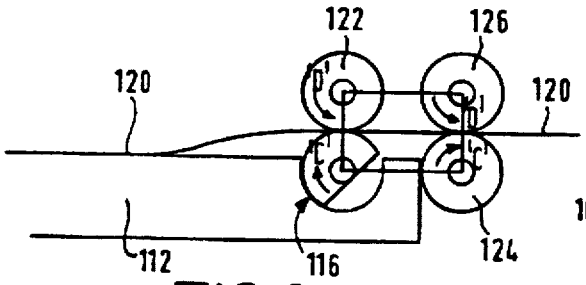
FIG.8
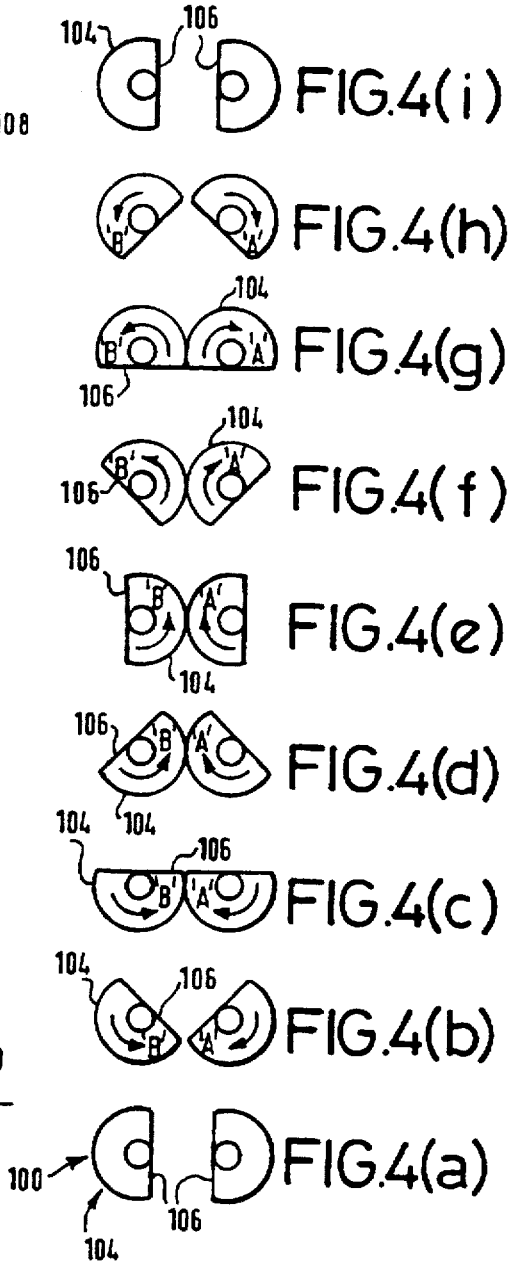

PROCESSING APPARATUS

FIELD OF THE INVENTION

The present invention relates to processing apparatus and is more particularly, although not exclusively, concerned with photographic processing apparatus for processing sheet materials.

BACKGROUND OF THE INVENTION

Two basic types of photographic processing apparatus are known for processing sheet materials. In one type of apparatus, the apparatus comprises a plurality of shallow processing trays, each of which has a large surface area and a complex roller system both to support the sheet material as it is being processed and to move it through the processing apparatus. Such apparatus has a relatively large 'foot print' as the processing path is substantially horizontal.

In the other type of apparatus, the processing tanks are deeper and narrower than the former type of apparatus and, as a result, have a smaller 'foot print'. This means that the material being processed may traverse a longer processing path to increase the overall throughput for the apparatus. The sheet material being processed needs to be supported or restrained in some way in each of the processing tanks, particularly as the processing tanks are deep, so that the material can be removed therefrom at the end of its processing time in that tank.

In one embodiment of this latter type of apparatus, the processing of the sheets may be continuous and the process time is fixed. This means that, for each sheet of material being processed, the process time has to be the same with the leading edge of each sheet of material entering and leaving each processing tank before the trailing edge. A plurality of sheets of material can be fed into the apparatus for processing, each sheet being separated from adjacent sheets by a gap. These sheets of material are driven through the processor by means of rollers, positioned along the processing path through the apparatus, which are spaced so that driving contact is always made with each sheet. In some instances, this means that three offset rollers need to be in contact with the sheet material, that is, two rollers acting on one side of the material and one on the other. In other instances, roller pairs are utilized wherein the sheet material is always in contact with two roller pairs.

In a further embodiment of the latter type of apparatus, the sheet is supported by a frame and passed from processing tank to processing tank in the frame. This type of apparatus is sometimes known as 'dip-and-dunk' apparatus as the sheet material being processed is dipped into each processing tank whilst being retained in its supporting frame.

It is well known to use D-shaped rollers to feed sheet materials. Examples of this use are described in U.S. Pat. No. 5,316,283, U.S. Pat. No. 5,255,903, U.S. Pat. No. 5,222,724, U.S. Pat. No. 5,184,533, U.S. Pat. No. 4,990,011 and EP-A-0 401 807. In all of these examples, the D-shaped roller acts directly on a stack of sheet material to move the sheet off the stack and feed it on to other apparatus.

PROBLEM TO BE SOLVED BY THE INVENTION

As described above, in the latter type of processing apparatus, the material needs to be supported or restrained in the processing tank so that it can be readily removed once processing has been completed in that processing tank. Non-uniform processing of the material may result because of insufficient agitation of the processing solutions due to the presence of the support or restraint.

Whilst most of the processing apparatus described above have covers for the processing tanks, in particular, the developer tank, to reduce the aerial oxidation of the developer solution by reducing the amount of solution which makes contact with the atmosphere, they are still unsuitable for use with unstable processing chemistry, for example, redox amplification chemistry, due to the large volumes of processing solutions required. The requirement for large volumes of processing solution is related to the number of rollers which needs to be utilized to provide effective transport of the sheet material through the processing tank if the processing apparatus is not of the 'dip-and-dunk' type.

In the case of the 'dip-and-dunk' type of apparatus, other problems are encountered. In particular, it is often the case that it is not possible to process the entire sheet material due to the presence of the retaining frame. The presence of the frame may also have an effect on the agitation of the processing solution in the tank and thus affect the uniformity of the processing obtained.

Furthermore, with 'dip-and dunk' type apparatus, the leading edge of the sheet being processed always enters a processing tank before the trailing edge, the trailing edge leaving the processing tank before the leading edge. This has may produce a 'processing gradient' between the leading and trailing edges of the sheet material, that is, the leading edge has received more processing than the trailing edge.

Moreover, as the sheet material is supported in a frame for processing in a 'dip-and-dunk' type processor, there may be substantial carry over of processing solutions from one processing tank to the next contaminating the solution in the next processing tank. For example, there may be carry over of developer solution from the developer tank to the bleaching or bleach/fixing tank.

SUMMARY OF THE INVENTION

It is therefore an object of the present invention to provide improved processing apparatus for sheet materials in which the volumes of processing solutions required are substantially less that presently required, thus allowing the use of unstable processing chemistry.

It is a further object of the invention to provide processing tanks in which oxidation effects are reduced.

It is another object of the present invention to provide processing apparatus in which high agitation rates can be achieved as the sheet material being processed is not obstructed by supporting rollers or restraining means, for example, a frame.

In accordance with one aspect of the present invention, there is provided a method of processing material in sheet form in processing apparatus comprising at least two processing tanks containing processing solutions, the method comprising inserting the material into each of the processing tanks in turn, characterized in that the material is turned end on end between processing tanks.

Each of the two processing tanks may contain the same type of processing solution although the concentration and constituents may be varied in accordance with a particular application.

In accordance with another aspect of the present invention, there is provided apparatus for processing material in sheet form, the apparatus comprising:

at least one processing tank containing processing solution; and transport means for transporting the material out of each processing tank;

characterized in that the transport means comprises, for each processing tank, at least one roller pair operable to grip the material in the processing tank and to direct it out of the processing tank when processing is complete.

Advantageously, the roller pair comprises at least one D-shaped roller which is rotatable about an axis to cooperate with the other roller of the roller pair.

It is preferred that both rollers of the roller pair are D-shaped rollers.

Advantageously, a plurality of processing tanks are provided and the apparatus further includes cross-over means associated with each processing tank for transferring material from that processing tank to an adjacent processing tank. The cross-over means includes a pair of transport rollers spaced from the roller pair in the processing tank a distance which is less than the circular circumferential distance of the at least one D-shaped roller to effect transfer of the material from the processing tank to the cross-over means.

ADVANTAGEOUS EFFECT OF THE INVENTION

In accordance with the method of the present invention, as the material is turned end on end, any non-uniformity of the processing which may produce a 'processing gradient', as described above, may be substantially eliminated.

Advantageously, by utilizing D-shaped rollers in the processing tanks, clear access to each tank is provided as the sheet material enters the tank, the D-shaped rollers acting on the material to direct it out of the tank when processing has been completed in that tank. Improved agitation of the processing solution is also achieved as there is no need to support the material for during processing.

In the apparatus of the present invention, processing times of individual sheets of material can easily be varied.

Contamination of the processing solutions as the material is passed from one processing tank to the next can also be minimized as transport rollers can also be used as squeegee rollers.

BRIEF DESCRIPTION OF THE DRAWINGS

For a better understanding of the present invention, reference will now be made, by way of example only, to the accompanying drawings in which:

FIG. 3 is a perspective view of a D-shaped roller in accordance with the present invention;

FIG. 4 illustrates the operation of a pair of D-shaped rollers to drive material therethrough;

FIG. 7 is a perspective view of is an enlarged view of the roller area of FIGS. 5 and 6; and FIG. 8 is a schematic side elevation corresponding to FIG. 7.

DETAILED DESCRIPTION OF THE INVENTION

Figure 1:
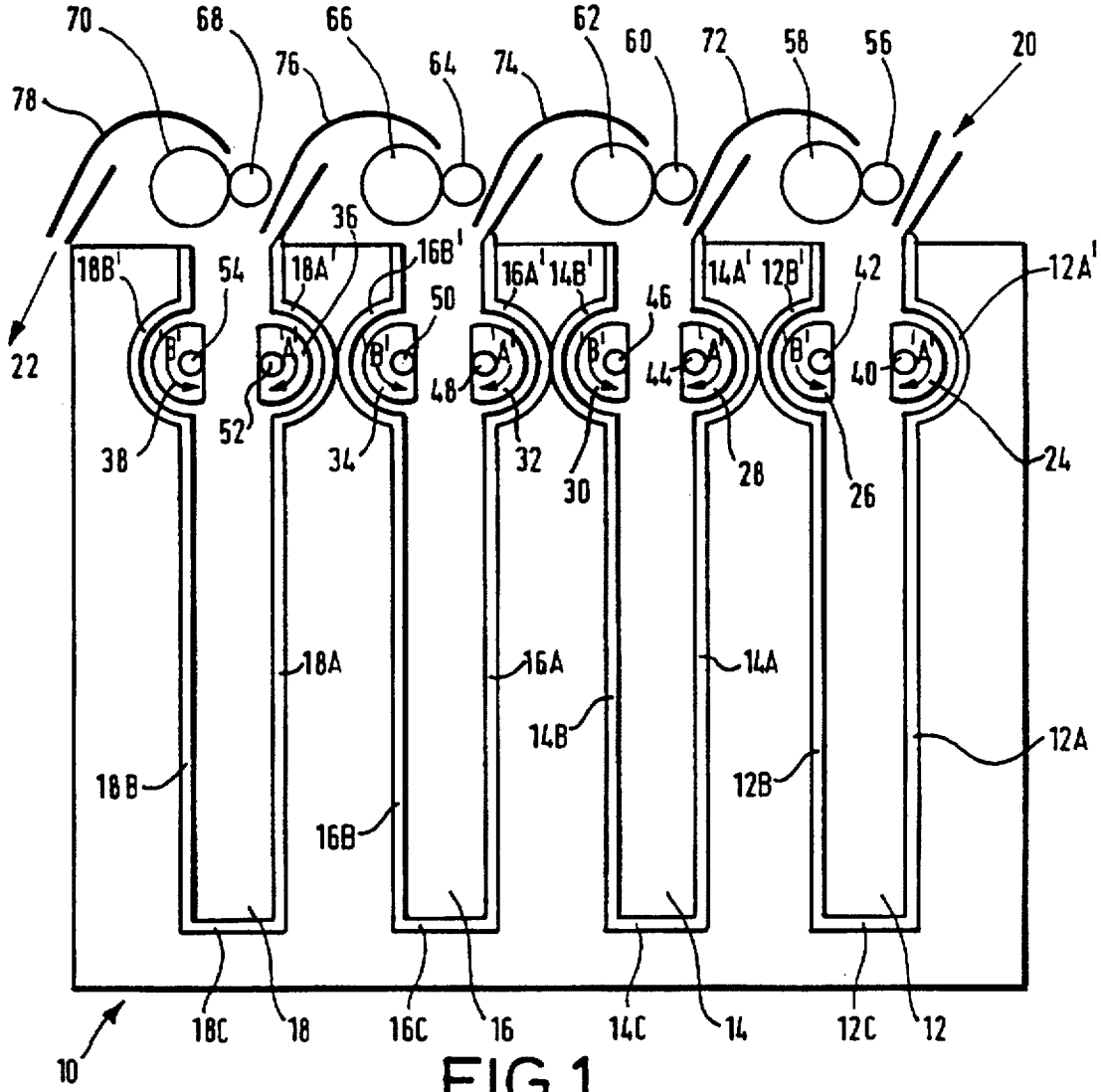
FIG. 1 is a schematic side elevation of photographic processing apparatus in accordance with one embodiment of the present invention.

In FIG. 1, a photographic processor 10 for processing sheet materials in accordance with the present invention is shown. The processor 10 is designed to process sheet materials of A4 format either as a 'portrait' (the length of the sheet being vertical) or as a 'landscape' (the length of the sheet being horizontal), and comprises a plurality of processing tanks 12, 14, 16, 18 mounted therein. Each processing tank 12, 14, 16, 18 has a pair of opposed side walls 12A, 12B, 14A, 14B, 16A, 16B, 18A, 18B and a bottom wall 12C, 14C, 16C, 18C. The side walls 12A, 12B, 14A, 14B, 16A, 16B, 18A, 18B separated by a distance which is sufficient to allow free access of the material to be processed into each processing tank 12, 14, 16, 18, and to allow adequate agitation of the processing solution on the emulsion surface (s) of the material being processed. A typical separation between the side walls 12A, 12B, 14A, 14B, 16A, 16B, 18A, 18B may be 5 mm. Angled jets (not shown) may be provided in the side walls 12A, 12B, 14A, 14B, 16A, 16B, 18A, 18B to assist the entry of the material into the processing tank.

Material to be processed (not shown in FIG. 1) is directed into the processor 10 through inlet 20 and is removed from the processor through outlet 22.

A pair of D-shaped rollers 24, 26 is mounted towards the top of processing tank 12 as shown. Similarly, for the remaining processing tanks 14, 16, 18, pairs of D-shaped rollers 28, 30 and 32, 34 and 36, 38 are mounted in respective processing tanks 14, 16 and 18 as shown. Naturally, side walls 12A, 12B, 14A, 14B, 16A, 16B, 18A, 18B of each processing tank is modified in regions 12A', 12B', 14A', 14B', 16A', 16B', 18A', 18B' to accommodate respective ones of the rollers 28, 30, 32, 34, 36, 38.

Each processing tank 12, 14, 16, 18 is sized to accommodate the size of the material being processed, the tank being of sufficient size to allow the largest sheet to be fully immersed in processing solution. The depth of each processing tank being such that the uppermost edge of the sheet of material being processed lies between the D-shaped rollers so that it can be removed from the processing tank after processing has been completed.

It will be readily appreciated that the bottom wall 12C, 14C, 16C, 18C of each processing tank 12, 14, 16, 18 may be adjustable along side walls 12A, 12B, 14A, 14B, 16A, 16B, 18A, 18B to vary the depth of the processing tank and hence the size of sheet material which can be accommodated therein.

Each D-shaped roller 24, 26, 28, 30, 32, 34, 36, 38 is rotatably mounted on a respective axis 40, 42, 44, 46, 48, 50, 52, 54. Each right-hand D-shaped roller 24, 28, 32, 36 (as viewed in FIG. 1) can be rotated about its respective axis 40, 44, 48, 52 in the direction indicated by arrow 'A'. Similarly, each left-hand D-shaped roller 26, 30, 34, 38 can be rotated about its respective axis 42, 46, 50, 54 in the direction indicated by arrow 'B'.

Each D-shaped roller pair 24, 26; 28, 30; 32, 34; and 36, 38 is arranged so that, in the position shown in FIG. 1, there is clear access to the associated processing tank 12, 14, 16, 18 for the material being processed.

The diameters of the D-shaped rollers 24, 26, 28, 30, 32, 34, 36, 38 and the separation of respective axes 40, 42, 44, 46, 48, 50, 52, 54 for each roller pair are chosen so that when the rollers 24, 26, 28, 30, 32, 34, 36, 38 are rotated about their respective axes 40, 42, 44, 46, 48, 50, 52, 54 in the directions indicated by arrows 'A' and 'B', material lying between the rollers is gripped and transported upwardly out of the appropriate processing tank.

Typically, the D-shaped rollers have a diameter of 25 mm and a flat portion defined by a chord subtended by an angle of approximately 29°, typically having a width of approximately 12 mm. The axes 40, 42, 44, 46, 48, 50, 52, 54 of the D-shaped rollers forming each pair are separated by a distance of 25 mm, that is, the diameter of the D-shaped rollers themselves.

It will be readily understood that these dimensions given above are not limiting and will depend on the particular roller and processing tank arrangement. The axes 40, 42, 44, 46, 48, 50, 52, 54 may be separated by a greater distance and a suitable mechanism is provided to bring the rollers together to effect removal of the sheet material after processing.

Transport rollers 56, 58, 60, 62, 64, 66, 68, 70 are arranged in pairs above the processing tanks 12, 14, 16, 18, as shown, for receiving the material as it is directed upwardly out of each processing tank 12, 14, 16, 18 by rotation of the associated D-shaped roller pairs 24, 26; 28, 30; 32, 34; and 36, 38.

In order to reduce contamination of processing solutions in subsequent processing tanks due to processing solution being carried over from a preceding tank, the transport rollers 56, 58, 60, 62, 64, 66, 68, 70 may comprise squeegee rollers which remove excess processing solution from the sheet material as it is transferred from tank to tank.

Respective guide elements 72, 74, 76, 78 are associated with each processing tank 12, 14, 16, 18 and each pair of the transport rollers 56, 58, 60, 62, 64, 66, 68, 70 to direct the material either into the next processing tank or to the outlet 22. These guide elements 72, 74, 76, 78 form the cross-overs between adjacent processing tanks.

Figure 2:
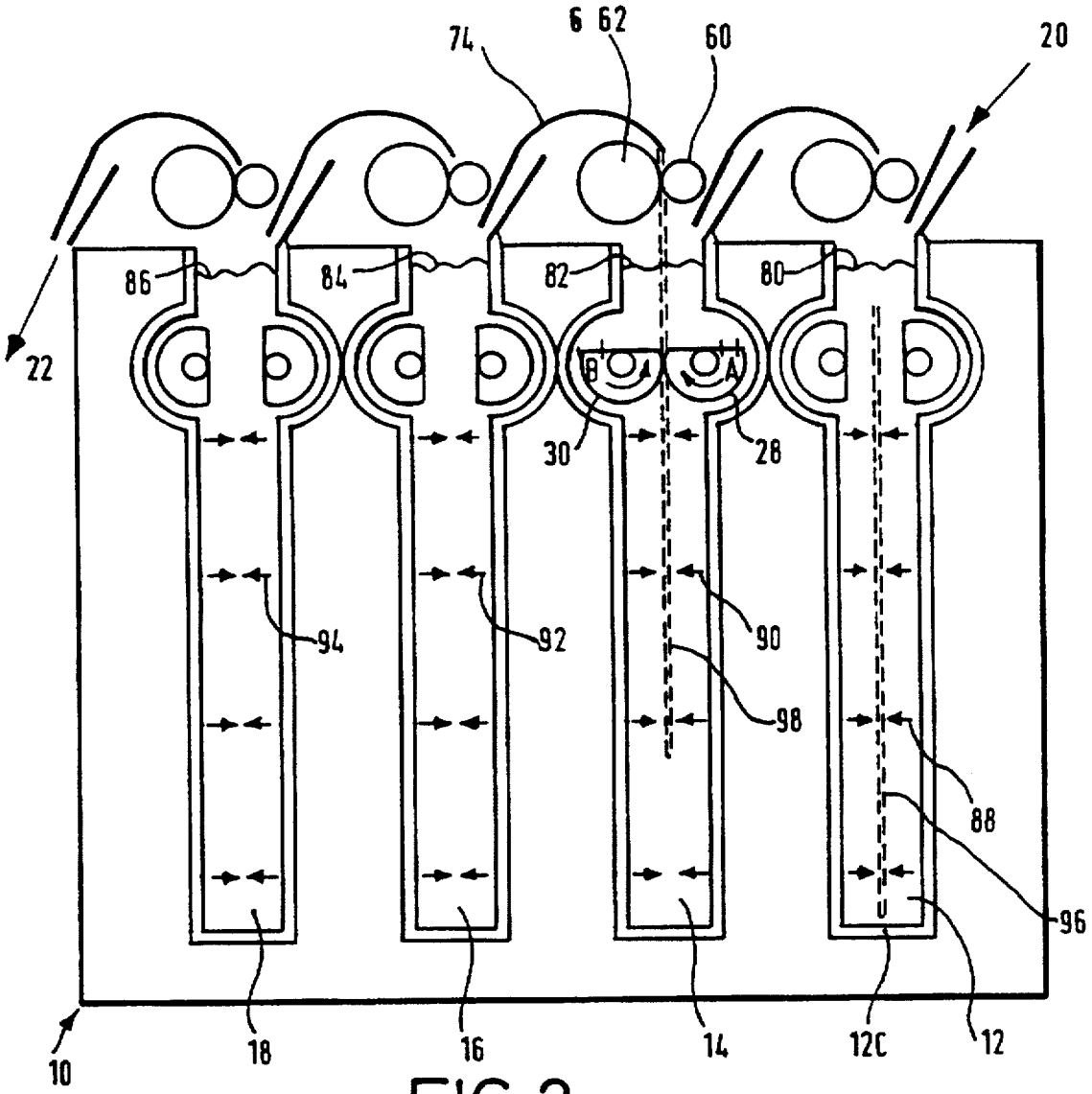
FIG. 2 is similar to FIG. 1 and illustrates the operation of the apparatus in accordance with the present invention.

FIG. 2 is similar to FIG. 1, but now illustrates each processing tank 12, 14, 16, 18 filled with processing solution to respective levels 80, 82, 84, 86. Agitation of the processing solution in the body of each processing tank 12, 14, 16, 18 is achieved by means of jets 88, 90, 92, 94 as shown.

Two sheets of material 96, 98 being processed are shown passing through tanks 12, 14 of the processor 10. Sheet 96 has entered the processor 10 via inlet 20 and passed into tank 12. Sheet 98 has entered the processor 10 as described for sheet 96, been processed in tank 12, and has been transferred to tank 14.

Sheet 96 is resting on the bottom wall 12C of the tank 12 as it is undergoing processing. It may be self-supported due to its inherent stiffness. Processing solution is being directed at both surfaces of the sheet 96 by means of jets 88, which may either alternatively or additionally, support the sheet 96 during processing. Once processing is complete, the sheet 96 is moved to the next processing tank (not shown).

Processing of sheet 98 in tank 14 has been completed and D-shaped rollers 28, 30 have been rotated in their respective directions indicated by arrows 'A' and 'B' so that external surfaces of the rollers 28, 30 meet and nip the sheet 98 therebetween.

As described previously, the diameters of the rollers and the separation between their respective axes are chosen so that the rollers meet and nip the sheet when they are rotated.

Further rotation of the rollers 28, 30 forces the sheet 98 out of the tank 14 and into transport rollers 60, 62, as shown, for direction on to tank 16 via guide element 74. Transport rollers 60, 62 and D-shaped rollers 28, 30 are driven so that they impart the same linear speed to the sheet during the transfer from one processing tank to the next processing tank.

The circular circumference of the D-shaped rollers is chosen to be greater than the distance from the D-shaped rollers to the transport rollers. This ensures that the material is guided into the transport rollers by the D-shaped rollers.

As will be readily appreciated, sheet 96 in tank 12 will be turned on its end as it is directed into tank 14. Similarly, on leaving tank 14, the sheet 96 will be turned on its end again so that it lies in the same orientation in tank 16 as it does in tank 12.

Each of the processing tanks 12, 14, 16, 18 may contain different processing solutions. However, it is advantageous to group the processing tanks together in pairs, each tank in a pair containing the same processing solution. This has the effect of making the chemical usage more efficient and as the sheet is turned end on end as it passes from one tank to the next, more even processing of the material can be obtained. For example, leading edge 96A of sheet 96 rests on bottom wall 12C of tank 12 and enters the processing solution before trailing edge 96B. This means that a processing gradient may be set up across the sheet 96 with the leading edge 96A having been processed for a longer time than trailing edge 96B. On entry to the next processing tank 14, the trailing edge 96B (not shown in FIG. 2) becomes the leading edge in this processing tank and the leading edge 96A becoming the trailing edge.

In the embodiment shown in FIG. 2, processing tanks 12 and 14 may contain developer solution and tanks 16 and 18 bleach/fix solution, with a further two processing tanks (not shown) containing wash solutions therein.

Each processing tank containing a particular type of processing solution may have the same constituents and/or concentration. Alternatively, it may desirable to vary the concentration and/or constituents for that type of solution.

Although the processor 10 has been described as having four processing tanks 12, 14, 16, 18, it will readily be understood that any number of processing tanks can be employed in accordance with a particular application.

Although the roller pair described with reference to FIGS. 1 and 2 includes at least one D-shaped roller, it may be possible to provide the desired access using standard rollers which move into engagement with one another when it is required to remove the processed sheet from the processing tank.

As an alternative to the sheet of material being self-supporting or supported by the action of the jets as discussed above, the sheet may be held against one side wall of the processing tank by suction. Naturally, this is only possible with single-sided material, that is, sheets having only one surface to be processed.

The tank wall may have a textured finish to allow processing solution to be freely taken up by the sheet as it slides in and out of the processing tank. This is particularly important where the material is photographic material and the emulsion surface is required to absorb processing solution.

Output can be high for the size of the processor as the sheet transport speed through the cross-over, that is, between adjacent processing tanks, is not related to the processing speed. Processing times can be varied from tank to tank to suit the activity of the chemicals therein, the level of exposure or different mixes of photographic materials. Furthermore, the apparatus is not limited to processing a single sheet of material at a time.

Apparatus in accordance with the present invention can be used with any type of photographic material including radiographic film materials which have emulsion on both surfaces.

In FIG. 3, a D-shaped roller 100 is shown in more detail. It comprises a roller portion 102 having a circular circumferential portion 104 and a flat portion 106, the roller portion 102 being mounted on a shaft 108.

FIG. 4 illustrates nine stages of operation of a pair of the D-shaped rollers 100 as described in FIG. 2 as a sheet of material is being removed from a processing tank, the material not being shown for clarity. At stage (i), the rollers 100 are in the normal processing position. When processing has been completed in the tank, rotation of the rollers 100 in the directions indicated by arrows 'A' and 'B' respectively, stage (ii), brings the circumferential portions 104 of the two rollers 100 together, stage (iii). Further rotation of in the directions of arrows 'A' and 'B' keeps the rollers 100 in contact along their circumferential portions 104, stages (iv), (v), (vi) and (vii), until flat portions 106 are reached again, stage (viii) and finally to stage (ix) where the rollers 100 are in the normal processing position which allows free access of material to the processing tank.

Figure 5:
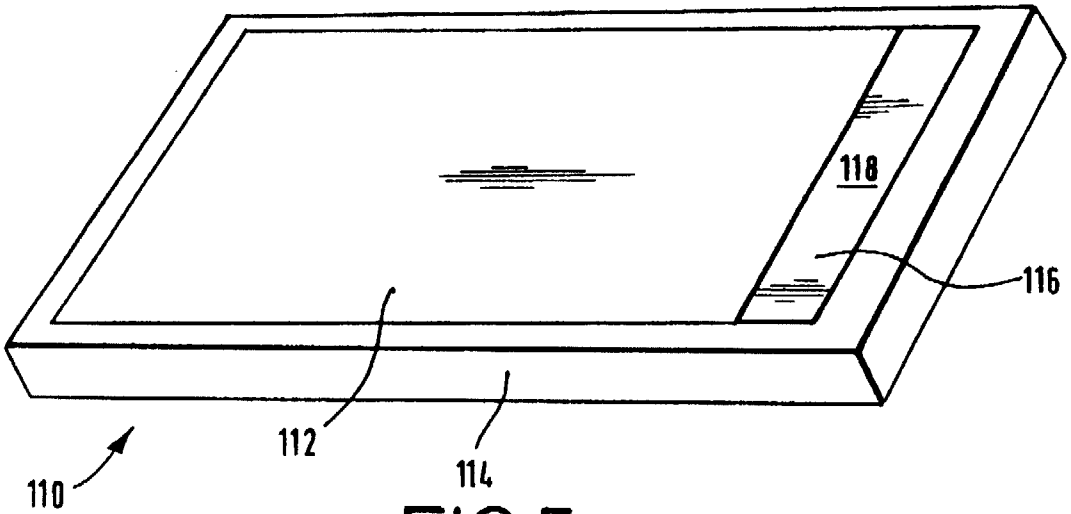
FIG. 5 is a perspective view of a second embodiment of the present invention.
Figure 6:
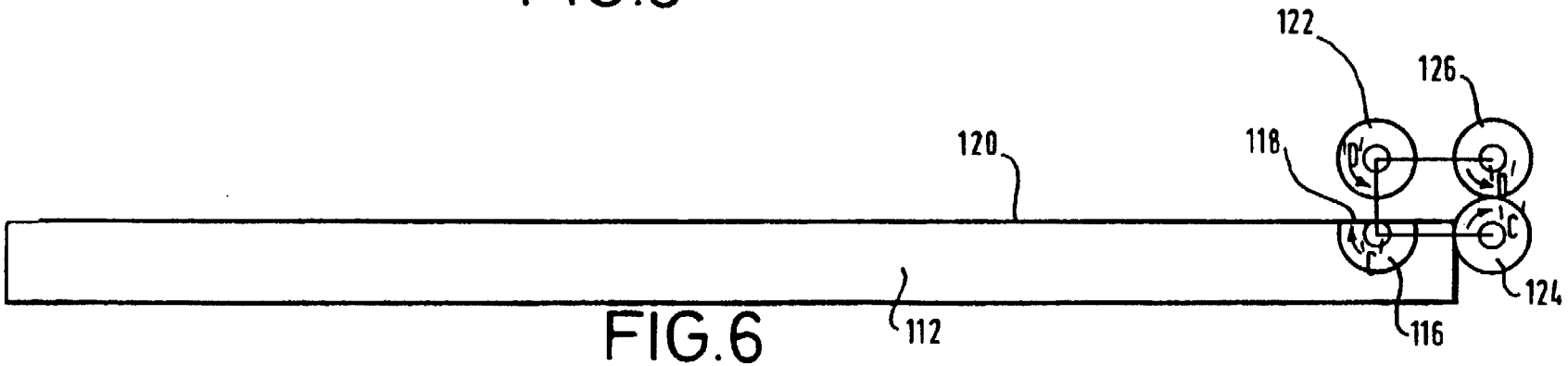
FIG. 6 illustrates a schematic side elevation corresponding to FIG. 5.

FIGS. 5 and 6 illustrate another embodiment of processing apparatus in accordance with the present invention. In FIG. 5, a flat bed processor 110 is shown for processing sheets of material. The processor 110 comprises a platen 112 mounted in a frame 114. A D-shaped roller 116 is positioned at one end of the frame 114 adjacent the platen 112 with its flat portion 118 uppermost forming a substantially continuous flat processing surface with the platen 112. The material to be processed can be held on to the surface of the platen 112 by suction applied by a vacuum pump through holes in the platen surface (not shown). Any other suitable means can also be employed to retain the material on the platen surface for processing.

In FIG. 6, a sheet of material 120 is shown on the surface of the platen 112 and flat portion 118 of roller 116. A cooperating roller 122 is positioned above roller 116 and spaced therefrom to allow rotation of roller 116. A pair of transport rollers 124, 126 are located a distance from roller pair 116, 122 for receiving the material 120 after it has been processed. As described with reference to FIG. 2, the transport rollers 124, 126 are spaced from rollers 116, 122 a distance which is less than the circular circumference of the roller 116. Rollers 116, 124 and rollers 122, 126 are driven for rotation in the direction indicated by arrows 'C' and 'D' respectively.

FIGS. 7 and 8 illustrate how the sheet of material 120 is lifted from the surface of the platen 112 by the D-shaped roller 116. In FIG. 7, rotation of the D-shaped roller 116 in the direction indicated by arrow 'C' moves its circular circumferential portion 116' it out of the plane of the platen 112 and lifts the material 120 with it. This is shown more clearly in FIG. 8.

FIG. 8 shows that the material 120 has been lifted off the surface of the platen 112 and directed, due to the operation of roller pair 116, 122, to transport roller pair 124, 126.

Rollers 116, 122, 124 and 126 can be connected together by suitable gearing using a single drive, for example, a motor.

The embodiment described in FIGS. 5 to 8 provides a simple effective way of lifting the processed material off the platen and driving it to transport rollers.

Although the embodiment illustrated in FIGS. 5 to 8 is described as being a flat bed processor, it will be readily appreciated that the arrangement can easily be adapted to lie in a vertical plane with platen 112 being positioned substantially vertically. Other suitable angles are also possible.

PARTS LIST

10 . . . processor
12,14,16,18 . . . processing tanks
12A,12B,14A,14B,16A,16B,18A,18B . . . side walls
12A,12B,14A,14B,16A,16B,18A,18B . . . regions
12C,14C,16C,18C . . . bottom wall
20 . . . inlet
22 . . . outlet
24,26,28,30,32,34,36,38 . . . D-shaped rollers
40,42,44,46,48,50,52,54 . . . axis
56,58,60,62,64,66,68,70 . . . transport rollers
72,74,76,78 . . . guide elements
80,82,84,86 . . . levels
88,90,92,94 . . . jets
96,98 . . . sheets of material
96A . . . leading edge
96B . . . trailing edge
100 . . . D-shaped roller
102 . . . roller portion
104 . . . circumferential portion
106 . . . flat portion
108 . . . shaft
110 . . . flat bed processor
112 . . . platen
114 . . . frame
116 . . . D-shaped roller
118 . . . flat portion
120 . . . sheet of material
122 . . . cooperating roller

We claim:

1. A method of processing material in sheet form in processing apparatus comprising at least two processing tanks containing processing solutions, the method comprising inserting the material into each of the processing tanks in turn, characterized in that the material is turned end on end between processing tanks.

2. A method according to claim 1, wherein each of the two processing tanks contains the same type of processing solution.

3. A method according to claim 2, wherein the processing solution in each tank has the same concentration.

4. A method according to claim 2, wherein the processing solution has the same constituents.

5. Apparatus for processing material in sheet form, the apparatus comprising:

a plurality of processing tanks, each tanks containing processing solution; and transport means for transporting the material out of each processing tank;

characterized in that the transport means comprises, for each processing tank, at least one roller pair operable to grip the material in the processing tank and to direct it out of the processing tank when processing is complete, and cross-over means are provided associated with each processing tank for transferring material end-to-end from the processing tank to an adjacent processing tank.

6. Apparatus according to claim 5, wherein the roller pair comprises at least one D-shaped roller which is rotatable about an axis to cooperate with the other roller of the roller pair.

7. Apparatus according to claim 6, wherein both rollers of the roller pair are D-shaped rollers.

8. Apparatus according to claim 6, wherein the circumferential surface of each roller in a roller pair act together as nip rollers.

9. Apparatus according to claim 5, wherein the cross-over means includes a pair of transport rollers spaced from the roller pair in the processing tank a distance which is less than the circular circumferential distance of the at least one D-shaped roller to effect transfer of the material from the processing tank to the cross-over means.

10. Apparatus according to claim 5, wherein the material to be processed is photographic material and the apparatus is photographic processing apparatus.

11. Apparatus for processing material in sheet form, the apparatus comprising:

at least one processing tank containing processing solution; and transport means for transporting the material out of each processing tank;

characterized in that the transport means comprises, for each processing tank, at least one roller pair operable to grip the material in the processing tank and to direct it out of the processing tank when processing is complete, said roller pair comprises at least one D-shaped roller which is rotatable about an axis to cooperate with the other roller of the roller pair.

* * * * *